US007146969B2

(12) United States Patent
Weirich

(10) Patent No.: US 7,146,969 B2
(45) Date of Patent: Dec. 12, 2006

(54) MOTOR VEHICLE COMPRISING AN ACTIVATED CARBON FILTER AND METHOD FOR REGENERATING AN ACTIVATED CARBON FILTER

(75) Inventor: Marko Weirich, Mannheim (DE)

(73) Assignee: DaimlerChrysler AG, Stuttgart (DE)

( * ) Notice: Subject to any disclaimer, the term of this patent is extended or adjusted under 35 U.S.C. 154(b) by 288 days.

(21) Appl. No.: 10/482,769

(22) PCT Filed: May 10, 2002

(86) PCT No.: PCT/EP02/05157

§ 371 (c)(1),
(2), (4) Date: Jun. 21, 2004

(87) PCT Pub. No.: WO03/004853

PCT Pub. Date: Jan. 16, 2003

(65) Prior Publication Data

US 2004/0231319 A1 Nov. 25, 2004

(30) Foreign Application Priority Data

Jun. 30, 2001 (DE) ..... 101 31 798

(51) Int. Cl.
*F02M 33/04* (2006.01)

(52) U.S. Cl. ..... 123/520

(58) Field of Classification Search ..... 123/520
See application file for complete search history.

(56) References Cited

U.S. PATENT DOCUMENTS 4,127,097 A 11/1978 Takimoto
4,630,581 A * 12/1986 Shibata ..... 123/325
5,272,873 A 12/1993 Hamazaki
5,535,719 A * 7/1996 Morikawa et al. ..... 123/339.17
5,944,003 A * 8/1999 Osanai ..... 123/698
5,988,150 A * 11/1999 Osanai ..... 123/698
6,039,032 A 3/2000 Morikawa et al.

FOREIGN PATENT DOCUMENTS

| | | |
|---|---|---|
| DE | 807146 | 6/1951 |
| EP | 1106815 | 6/2001 |
| GB | 1098060 | 2/1966 |

* cited by examiner

*Primary Examiner*—Thomas Moulis
(74) *Attorney, Agent, or Firm*—Collard & Roe, P.C.

(57) ABSTRACT

1. Motor vehicle having an activated carbon filter and method for regenerating an activated carbon filter.

Figure 1:
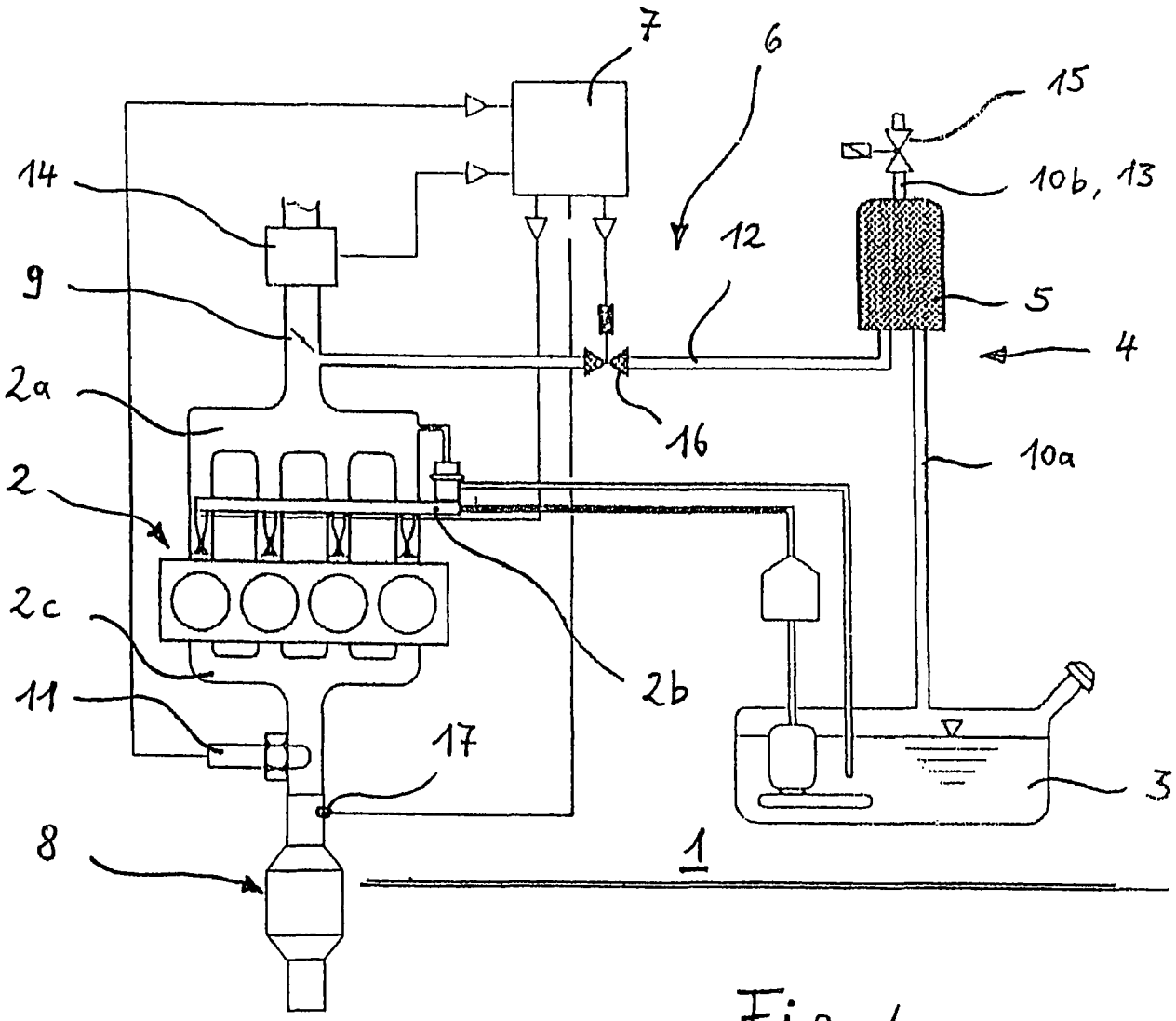

2. A motor vehicle (1) is proposed, comprising an, in particular, direct-injection internal combustion engine (2), a fuel tank (3) and an aeration device (4) for the fuel tank that comprises an activated carbon filter (5) and a regeneration device (6) for regenerating the activated carbon filter, and a method for regenerating an activated carbon filter in a motor vehicle comprising an, in particular, direct-injection internal combustion engine.

2.2. According to the invention, a regeneration device (6) is provided in the motor vehicle and is assigned a control device (7) which undertakes an activation of the regeneration device (6) in the overrun mode of the internal combustion engine (2); for the method, provision is made for an overrun mode of the internal combustion engine to be detected in one method step and for a regeneration device which is assigned to the activated carbon filter and is intended for purging the activated carbon filter with fresh air to be activated in a subsequent method step.

2.3. To be used in motor vehicles, in particular passenger vehicles.

11 Claims, 1 Drawing Sheet

MOTOR VEHICLE COMPRISING AN ACTIVATED CARBON FILTER AND METHOD FOR REGENERATING AN ACTIVATED CARBON FILTER

CROSS REFERENCE TO RELATED APPLICATIONS

Applicant claims priority under 35 U.S.C. §119 of GERMAN Application No. 101 31 798.0 filed on Jun. 30, 2001. Applicant also claims priority under 35 U.S.C. §365 of PCT/EP02/05157 filed on May 10, 2002. The international application under PCT article 21(2) was not published in English.

The invention relates to a motor vehicle comprising an internal combustion engine, a fuel tank and an aeration device for the fuel tank that comprises an activated carbon filter and a regeneration device for regenerating the activated carbon filter, and, secondly, to a method for regenerating an activated carbon filter in a motor vehicle having an internal combustion engine.

Motor vehicles in which an activated carbon filter of the fuel tank is assigned a vacuum pump for ventilating the activated carbon filter are generally known.

In contrast, the object of the invention is to provide a generic motor vehicle and a corresponding method, in which the activated carbon filter can be regenerated with particularly simple means and without the internal combustion engine consuming fuel.

This object is achieved by a motor vehicle having the features of claim 1 and by a method having the features of claim 7.

The motor vehicle according to the invention is distinguished by a control device which is assigned to the regeneration device and undertakes an activation of the regeneration device in the overrun mode of the internal combustion engine and, in the overrun mode of the internal combustion engine, brings about an interruption of a fuel injection and an induction of fresh air primarily via the activated carbon filter, an ignition of the mixture in the internal combustion engine being avoided during the regeneration of the activated carbon filter by the fact that, when the need arises, the regeneration device is partially deactivated, and/or the induction air element is opened and/or an ignition of the internal combustion engine is switched off. The internal combustion engine can be used in this case as a suction pump for extracting air from the activated carbon filter. In this case, the "normal" induction tract (suction pipe) of the internal combustion engine is shut off or throttled by means of an induction air inlet element while an extraction pipe produces a connection between the activated carbon filter and internal combustion engine. In a modified exemplary embodiment, a mechanical supercharger of the internal combustion engine is used as suction pump for evacuating the activated carbon filter.

In one refinement of the invention, the internal combustion engine is assigned an exhaust-gas cleaning system, the control device undertaking an activation of the regeneration device when the exhaust-gas cleaning system is at virtually full capacity. This ensures that the hydrocarbons which are removed from the activated carbon filter can be degraded in the exhaust-gas cleaning system.

In a further refinement of the invention, the internal combustion engine is assigned an induction air inlet element, the control device undertaking an activation of the regeneration device when the induction air inlet element is virtually closed and/or undertaking a control of the induction air mass by means of the induction air inlet element. In the overrun mode of the internal combustion engine, there is a vacuum downstream of the induction air element, in the direction of flow, it being possible for the vacuum to be controlled by the induction air inlet element and it being possible for it to be used in a simple manner to extract the contents of the activated carbon filter. The induction air inlet element can also and specifically be provided in quality-controlled internal combustion engines, it not being used in this case to control the power of the engine.

In a further refinement of the invention, the exhaust-gas cleaning system is assigned a probe which can be used to detect the composition of the gas mixture in the internal combustion engine, the control device undertaking an at least partial deactivation of the regeneration device and/or an opening of the induction air inlet element and/or a switching-off of an ignition of the internal combustion engine before detection of an ignitable gas mixture in the internal combustion engine. The probe is arranged close to the internal combustion engine, so that, preferably, the fuel/air ratio can be detected reliably in the cylinders of the internal combustion engine. Since an ignitable mixture is to be avoided in the cylinders of the internal combustion engine, the control device is designed in such a manner that uses a corresponding "safety margin" to reduce or end a regeneration of the activated carbon filter at an early point if the composition of the mixture in the internal combustion engine is approaching the ignitable range. As an alternative or in addition, an addition of fresh air via the "normal" induction tract is provided by opening the induction air inlet element and/or switching off the ignition system/spark plugs in order to prevent a reaction in the internal combustion engine.

In a further refinement of the invention, the probe is designed as a lambda probe which is arranged between the internal combustion engine and exhaust-gas cleaning system. A lambda probe of this type is available in most known systems and can be used at the same time for the proposed invention.

In a further refinement of the invention, the regeneration device has an extraction pipe, which can be shut off, between the internal combustion engine and activated carbon filter, and a fresh air supply line to the activated carbon filter, the extraction pipe leading, downstream of the induction air inlet element, in the direction of flow, into the induction tract of the internal combustion engine. In order to activate the regeneration device in the overrun mode, the extraction pipe can be opened, so that ambient air or, by way of substitution, another fresh gas can pass via the fresh air supply line, which is likewise opened, to the activated carbon filter and from there on into the induction tract of the internal combustion engine.

The method according to the invention is distinguished by the fact that an overrun mode of the internal combustion engine is detected in one method step, a regeneration device which is assigned to the activated carbon filter and is intended for purging the activated carbon filter with fresh air is activated in a subsequent method step, and in the overrun mode of the internal combustion engine a fuel injection is interrupted and an induction of fresh air primarily via the activated carbon filter is brought about, an ignition of the mixture in the internal combustion engine during the regeneration of the activated carbon filter (5) being avoided by the fact that, when the need arises, the regeneration device is partially deactivated, and/or the induction air element is opened and/or an ignition of the internal combustion engine is switched off. In this case, the internal combustion engine, which is in overrun mode, is used as a suction pump for ventilating the activated carbon filter, the regeneration device being activated or deactivated as a function of the operating state of the internal combustion engine.

In one refinement of the invention, in the method, a fuel injection is interrupted in the overrun mode of the internal combustion engine and an induction of fresh air primarily via the activated carbon filter is brought about. This ensures that all of the fresh air which is taken in is guided via the activated carbon filter. It leaves the activated carbon filter loaded with hydrocarbons and is channeled through the internal combustion engine without ignition taking place.

In a further refinement of the invention, in the method, in order to activate the regeneration device, a fresh air supply to the activated carbon filter and an extraction pipe between the activated carbon filter and internal combustion engine are opened and an induction air inlet element of the internal combustion engine is closed. As induction air inlet element, a conventional throttle valve used for controlling the power of the engine is provided in quantity-controlled spark-ignition engines, and an additional throttle flap is provided in quality-controlled, in particular direct-ignition, spark-ignition and diesel engines.

In a further refinement of the invention, in the method, before the regeneration device is activated, an exhaust-gas cleaning system is checked with regard to its capacity. For this purpose, provision is made, in particular, to detect the temperature of the exhaust-gas cleaning system and to check whether the operating temperature of the exhaust-gas cleaning system has at least virtually been reached.

In a further refinement of the invention, in the overrun mode of the internal combustion engine, a probe is used to determine the air/fuel ratio in the internal combustion engine. The values which are obtained make it possible to monitor whether an ignitable mixture is forming in the internal combustion engine. The probe can be provided in the induction tract or in the exhaust-gas tract of the internal combustion engine. A lambda probe which is already present is preferably used.

In a further refinement of the invention, a threshold value for the air/fuel ratio in the internal combustion engine is defined and, if it has not been reached, the induction air inlet element of the internal combustion engine is opened and/or the regeneration device is deactivated. Since, when the regeneration device is activated, an air/fuel ratio above the ignitable range is generally initially present and can be reduced over the course of the regeneration, a predeterminable threshold value which is intended, as a function of the measuring parameters of the probe (position, response behavior, etc.), to provide a sufficient safety margin with respect to the ignitable range.

Further features and combinations of features emerge from the description and the drawings. Specific exemplary embodiments of the invention are illustrated in simplified form in the drawing and are explained in greater detail in the following description.

The single figure shows a schematic illustration of an aeration device according to the invention for the activated carbon filter of a motor vehicle fuel tank.

The figure schematically illustrates an internal combustion engine of a motor vehicle 1 in the form of a quality-controlled spark-ignition engine 2. The internal combustion engine 2 is supplied with its operating fuel via a direct-injection system 2*b*, with a stratified-charge operation of the internal combustion engine with a variable air/fuel ratio being realized (direct-injection spark-ignition engine). In a modified exemplary embodiment, the internal combustion engine is operated in accordance with the diesel method. The internal combustion engine 2 is assigned an exhaust pipe 2*c* with, arranged in it, an exhaust-gas cleaning system in the form of an oxidation-type catalytic converter 8 and a lambda probe 11 for detecting the oxygen content and the air/fuel ratio in the exhaust pipe.

An air induction inlet element in the form of a throttle valve 9 for throttling the induction air is provided in the air induction tract 2*a* of the internal combustion engine and is furthermore assigned an air-mass measuring device 14. The quantity of air supplied and/or the vacuum produced downstream of the throttle valve can therefore be set via the control device 7. In a modified exemplary embodiment, the internal combustion engine is designed as a quantity-controlled spark-ignition engine, the throttle valve serving to regulate the power of the engine.

The direct-injection system 2*b* removes the operating fuel from a fuel tank 3, liquid hydrocarbons preferably being provided as the operating fuel. The liquid hydrocarbons consist generally of different chemical substances which are present in a mixture. The liquid hydrocarbons furthermore have a tendency to evaporate, so that primarily vapors of the more volatile components form and fill the space above the liquid level in the fuel tank 3. When the fuel tank 3 is being filled or when it is being heated by environmental influences, gas or vapor has to be removed from the fuel tank so as to avoid a buildup of pressure in the fuel tank.

For this purpose, the fuel tank 3 is assigned an aeration device 4 via which gas can be conducted out of the fuel tank into the surroundings. The aeration device 4 contains a gas exchange line 10*a*, 10*b* for supplying gas to the fuel tank and removing it from the fuel tank. An activated carbon filter 5 is connected into the gas exchange line 10*a*, 10*b* and is used to remove hydrocarbon components from the gas conducted away to the surroundings. The hydrocarbon components removed from the air leaving the fuel tank are adsorbed by the activated carbon and stored in the activated carbon filter. Since the adsorption and storage potential of the activated carbon filter is exhausted at a certain load quantity, the activated carbon filter 5 has to be regenerated at certain time intervals.

For this purpose, the aeration device 4 is assigned a regeneration device 6 which comprises a fresh air supply line 13 and an extraction line 12. The fresh air supply line 13, which is otherwise identical with a part 10*b* of the gas exchange line of the fuel tank, can be shut off via a valve 15. The extraction line 12 connects the activated carbon filter 5 to the air induction tract 2*a* of the internal combustion engine 2, the induction line 12, as seen in the direction of flow, leading, directly downstream of the induction air inlet element of the internal combustion engine (throttle valve 9), into the induction tract 2*a* of the internal combustion engine and being able to be shut off by means of a further valve 16. The aeration device 4 is assigned a control device 7 which can be integrated into a central engine management system.

In the overrun mode of the internal combustion engine 2, i.e. if there is a negative torque in the internal combustion engine, the internal combustion engine can be used as a braking device for the moving motor vehicle. To detect the overrun mode of the internal combustion engine, a sensor arrangement (not illustrated) which transmits corresponding signals to the control device 7 is provided, for example, in the region of the crankshaft of the motor vehicle. The control device 7 is designed in such a manner that it can bring about, after an overrun mode of the internal combustion engine 2 is ascertained, an interruption of the fuel supply to the engine and a complete or partial closing of the throttle valve 9 in order to end the discharge of energy from the engine and instead to increase the absorption of energy (for example gas exchange work). Closing of the throttle valve 9 enables a vacuum to be produced between the throttle valve and the internal combustion engine when the internal combustion engine continues to be operated with a normal valve cycle.

After the overrun mode of the internal combustion engine has been detected, the control device 7 activates the regeneration device 6, in which case the valves 15, 16 are opened and the throttle valve 9 is essentially closed. In this case, the internal combustion engine operates as a pump and sucks in ambient air via the fresh air supply 13 into the activated carbon filter 5 and from the activated carbon filter via the extraction line 12 into the internal combustion engine. The supply of fresh air and, if appropriate, other measures cause the activated carbon filter 5 to release adsorbed hydrocarbons. The released hydrocarbons can be removed from the activated carbon filter via the fresh air which has been taken in and can be supplied to the exhaust-gas cleaning system 8, in which they are chemically and/or physically converted (in particular oxidized).

The gas mixture then supplied to the internal combustion engine 2 is then composed of fresh air, which is sucked in via gaps on the throttle valve, and of the mixture sucked in via the activated carbon filter. The air/fuel ratio of the resulting mixture is generally in a range above $\lambda=1.6$, so that there is no ignitable mixture in the combustion chambers of the internal combustion engine, the ignition device of the internal combustion engine therefore does not have to be switched off and a reliable conversion is ensured in the exhaust-gas cleaning system (requirement: $\lambda \geqq 1$). The composition of the mixture is monitored by means of the lambda probe 11, which is arranged between the internal combustion engine 2 and exhaust-gas cleaning system 8. In a modified exemplary embodiment, a probe is provided in the induction tract 2*a*. The air/fuel ratio in the resulting mixture is controlled via the control device 7, which controls the opening position of the throttle valve 9 and the opening position (passage cross section) of the valve 16 as a function of the signals of the probe 8. The induction of fresh air takes place primarily via the activated carbon filter 5.

In a further, modified exemplary embodiment, the control device 7 controls the composition of the resulting mixture using the signal of the air-mass measuring device 14 and the opening position of the valve 16 and/or using the signals of the probe 8.

A threshold value for a permissible air/fuel ratio at the probe 11 is stored in the control device 7, said fuel/air ratio correlating with the air/fuel ratio in the combustion chambers of the engine, with further boundary conditions on the part of the internal combustion engine being taken into consideration. If the threshold value, which is defined with a certain increased factor of safety, has not been reached, there is the risk of the resulting mixture in the internal combustion engine 2 igniting. In order to counteract this, the control device 7 causes the throttle valve 9 to open and/or the valve 16 in the extraction line 12 to close in good time. In a modified exemplary embodiment, the control device also causes the ignition in the internal combustion engine to be switched off.

The control device is furthermore assigned a temperature sensor 17 which detects the temperature of the exhaust-gas cleaning system 8. The exhaust-gas cleaning system 8 operates correctly only from a certain, previously known, minimum operating temperature (for example 250° C.), at which the complete capacity of the system, which is required, in particular, for the chemical/physical conversion of the hydrocarbons, is reached. The control device 7 activates the regeneration of the activated carbon filter preferably only when the exhaust-gas cleaning system 8 has reached its minimum operating temperature. If the maximum operating temperature is exceeded, the regeneration of the activated carbon filter is, if appropriate, completely or partially deactivated.

When the regeneration of the activated carbon filter 5 is activated, in particular when the valve 16 is opened, a precipitous change (generally a reduction) in the air/fuel ratio in the resulting mixture takes place. This change depends quantitatively on the loading state of the activated carbon filter 5: if the activated carbon filter is completely loaded, a particularly large leap takes place and, if the activated carbon filter is regenerated, the leap is virtually zero. The abovementioned, precipitous change in the air/fuel ratio in the resulting mixture can be detected by means of the lambda probe 11, which means that the control device 7 is able to make a conclusion as to the loading of the activated carbon filter 5 from the leap. Similarly, the progressive regeneration of the activated carbon filter can be detected by continuously detecting the air/fuel ratio at the probe 11. If a change in the air/fuel ratio no longer takes place, the control device 7 ends the regeneration of the activated carbon filter 5 by closing the valves 15, 16 and completely or partially opening the throttle valve 9. The control device 7 ends the regeneration of the activated carbon filter in a similar manner when the overrun mode of the internal combustion engine 2 is ended.

In a modified exemplary embodiment, the proposed regeneration of the activated carbon filter is combined with shutting off the cylinders in the internal combustion engine, the assumption being, firstly, that the cylinders which are switched off are virtually in the overrun mode and, secondly, the gas mixture originating from the regeneration is supplied to the cylinders which have been switched off.

By means of the proposed arrangement and the proposed operating method, the activated carbon filter can be reliably regenerated in a simple manner and using simple means. The vacuum which is produced by the engine in conjunction with an induction air inlet element in the overrun mode is used. The hydrocarbons which are released from the activated carbon filter during the regeneration are degraded reliably and in an environmentally friendly manner in the exhaust-gas cleaning system. A separate vacuum pump for evacuating the activated carbon filter is not required even in quality-controlled engines.

The invention claimed is:

1. A motor vehicle comprising
an internal combustion engine (2),
a fuel tank (3) and
an aeration device (4) for the fuel tank that comprises
an activated carbon filter (5) and
a regeneration device (6) for regenerating the activated carbon filter, wherein the regeneration device (6) is assigned a control device (7) which, in the overrun mode of the internal combustion engine (2), brings about
an activation of the regeneration device (6),
an interruption of a fuel injection, and
an induction of fresh air primarily via the activated carbon filter,
an ignition of the mixture in the internal combustion engine being avoided during the regeneration of the activated carbon filter (5) by the fact that, when the need arises,
the regeneration device is partially deactivated, and/or the induction air element is opened and/or an ignition of the internal combustion engine is switched off.

2. The motor vehicle as claimed in claim 1, wherein the internal combustion engine (2) is assigned an exhaust-gas cleaning system (8), the control device (7) undertaking an activation of the regeneration device when the exhaust-gas cleaning system is at virtually full capacity.

3. The motor vehicle as claimed in claim 1, wherein the internal combustion engine (2) is assigned an induction air inlet element, the control device (7) undertaking an activation of the regeneration device when the induction air inlet element is virtually closed and/or undertaking a control of the induction air mass by means of the induction air inlet element.

4. The motor vehicle as claimed in claim 1, wherein the exhaust-gas cleaning system (8) is assigned a probe which can be used to detect the composition of the gas mixture in the internal combustion engine, the control device (7) undertaking an at least partial deactivation of the regeneration device and/or an opening of the induction air inlet element and/or a switching-off of an ignition of the internal combustion engine before detection of an ignitable gas mixture in the internal combustion engine.

5. The motor vehicle as claimed in claim 4, wherein the probe is designed as a lambda probe which is arranged between the internal combustion engine and exhaust-gas cleaning system.

6. The motor vehicle as claimed in claim 1, wherein the regeneration device (6) has an extraction pipe, which can be shut off, between the internal combustion engine and activated carbon filter, and a fresh air supply line to the activated carbon filter, the extraction pipe leading, downstream of the induction air inlet element, in the direction of flow, into the induction tract of the internal combustion engine.

7. A method for regenerating an activated carbon filter in a motor vehicle (1) having an internal combustion engine, in particular a motor vehicle according to claim 1, in which an overrun mode of the internal combustion engine is detected in one method step, a regeneration device which is assigned to the activated carbon filter and is intended for purging the activated carbon filter with fresh air is activated in a subsequent method step, in the overrun mode of the internal combustion engine (2) a fuel injection is interrupted and an induction of fresh air primarily via the activated carbon filter (5) is brought an ignition of the mixture in the internal combustion engine during the regeneration of the activated carbon filter (5) is avoided by the fact that, when the need arises, the regeneration device is partially deactivated, and/or the induction air element is opened and/or an ignition of the internal combustion engine is switched off.

8. The method as claimed in claim 7, in order to activate the regeneration device, a fresh air supply to the activated carbon filter and an extraction pipe between the activated carbon filter and internal combustion engine are opened and an induction air inlet element of the internal combustion engine is closed.

9. The method as claimed in claim 7, wherein, before the regeneration device is activated, an exhaust-gas cleaning system is checked with regard to its capacity.

10. The method as claimed in claim 7 wherein, in the overrun mode of the internal combustion engine, a probe is used to determine the air/fuel ratio in the internal combustion engine.

11. The method as claimed in claim 9, wherein a threshold value for the air/fuel ratio in the internal combustion engine is defined and, if it has not been reached, the induction air inlet element of the internal combustion engine is opened and/or the regeneration device is deactivated.

* * * * *

UNITED STATES PATENT AND TRADEMARK OFFICE

CERTIFICATE OF CORRECTION

PATENT NO. : 7,146,969 B2
APPLICATION NO. : 10/482769
DATED : December 12, 2006
INVENTOR(S) : Weirich It is certified that error appears in the above-identified patent and that said Letters Patent is hereby corrected as shown below:

In particular, in Column 8, line 10 (Line 13 of Claim 7) after the word "brought" please insert: --about--.

Signed and Sealed this

Third Day of April, 2007

JON W. DUDAS
*Director of the United States Patent and Trademark Office*